US005865116A

United States Patent [19]

Keller et al.

[11] Patent Number: 5,865,116

[45] **Date of Patent: *Feb. 2, 1999**

[54] INK RECEPTIVE DAMPENING SYSTEM FOR LITHOGRAPHIC PRINTING PRESS

[76] Inventors: James J. Keller, 1806 E. Main St., Mesa, Ariz. 85203; David N. Clay, 14025 Tanglewood Dr., Farmers Branch, Tex. 75234

[ * ] Notice: The term of this patent shall not extend beyond the expiration date of Pat. No. 5,540,145.

[21] Appl. No.: 747,272

[22] Filed: Nov. 13, 1996

Related U.S. Application Data

[63] Continuation-in-part of Ser. No. 622,296, Mar. 25, 1996, abandoned, which is a continuation-in-part of Ser. No. 303,868, Sep. 9, 1994, Pat. No. 5,540,145, which is a continuation-in-part of Ser. No. 20,675, Feb. 22, 1993.

[51] Int. Cl.[6] ..... B41L 25/00; B41L 25/18

[52] U.S. Cl. ..... 101/148; 101/450.1; 101/DIG. 38

[58] Field of Search ..... 101/148, 348, 101/450.1, 451, 452, DIG. 38

[56] References Cited

U.S. PATENT DOCUMENTS

| | | | |
|---|---|---|---|
| 2,733,654 | 2/1956 | Rogers | 101/148 |
| 3,326,122 | 6/1967 | Wildeman | 101/148 |
| 3,688,694 | 9/1972 | Preuss et al. | 101/148 |
| 3,705,451 | 12/1972 | Dahlgren | 101/148 |
| 3,749,011 | 7/1973 | Abendroth et al. | 101/148 |
| 3,890,898 | 6/1975 | Fischer | 101/148 |
| 4,524,690 | 6/1985 | Omori | 101/148 |
| 4,676,156 | 6/1987 | Aylor et al. | 101/148 |
| 4,741,269 | 5/1988 | Aylor et al. | 101/148 |
| 4,841,855 | 6/1989 | Marcum | 101/148 |
| 4,901,640 | 2/1990 | Niemiro et al. | 101/148 |
| 4,949,637 | 8/1990 | Keller | 101/148 |
| 5,042,377 | 8/1991 | Palecek et al. | 101/148 |
| 5,046,418 | 9/1991 | Koehler et al. | 101/148 |
| 5,060,568 | 10/1991 | Jentzsch et al. | 101/148 |
| 5,062,362 | 11/1991 | Kemp | 101/148 |
| 5,107,762 | 4/1992 | Fadner et al. | 101/148 |
| 5,134,935 | 8/1992 | Hayes et al. | 101/148 |
| 5,372,067 | 12/1994 | Doyle, deceased | 101/148 |
| 5,429,046 | 7/1995 | Shiba et al. | 101/148 |

OTHER PUBLICATIONS

Advertisement for Orcas Hydrographic Systems

*Primary Examiner*—Stephen R. Funk

*Attorney, Agent, or Firm*—Gardere & Wynne L.L.P.; John W. Montgomery

[57] ABSTRACT

An apparatus for continuously providing dampening fluid to a plate cylinder of a lithographic printing press includes a frame operatively connected to the printing press. A dampening fluid reservoir is attached. A pan roller is rotatably mounted in the frame and is disposed in contact with dampening fluid in the dampening fluid reservoir. A transfer roller set tangentially contacts and is parallel to the pan roller. The transfer roller is rotated by friction from the pan roller which is driven at a rotation speed proportional to the speed of the plate cylinder. An ink receptive oscillating roller having a resiliently compressible surface is tangentially contacting and parallel to the transfer roller. The oscillating roller is gear driven at a rotational speed proportional to the speed of the plate cylinder. A water form roller is rotatably mounted in the frame tangentially contacting and in a parallel relation to both the plate cylinder and the resiliently compressible surface of the ink receptive oscillating roller for carrying an even metered layer of water from the oscillating roller to the plate cylinder.

17 Claims, 3 Drawing Sheets

INK RECEPTIVE DAMPENING SYSTEM FOR LITHOGRAPHIC PRINTING PRESS

CROSS-REFERENCE TO RELATED APPLICATIONS

This is a continuation-in-part of U.S. patent application Ser. No. 08/622,296, filed Mar. 25, 1996, now abandoned, which was a continuation application of U.S. patent application Ser. No. 08/303,868, filed Sep. 9, 1994, now issued as U.S. Pat. No. 5,540,145, which was a continuation-in-part application of U.S. patent application Ser. No. 08/020,675, filed on Feb. 22, 1993, now abandoned. Each of these applications was co-owned at the time of filing and at the time of the invention disclosed or claimed therein, and Applicant relies upon such prior applications for priority.

TECHNICAL FIELD OF THE INVENTION

The invention is directed to dampening roller systems for lithographic printing presses and in particular, to a dampening system having a gear driven intermediate oscillating roller and an ink receptive surface, which system is easily adapted for retrofitting existing lithographic presses.

BACKGROUND OF THE INVENTION

High speed rotary lithographic printing plates require ink to be continuously applied to a rotating plate cylinder carrying a printing plate having an ink receptive image chemically formed thereon. The image is transferred from the plate cylinder onto a blanket cylinder which rolls against paper to be printed and impresses the image onto the paper. In order to maintain even pressure between the plate cylinder and the blanket cylinder and to provide a clear, crisp image without smearing, the areas of the printing plate which do not receive ink are appropriately treated to receive a thin coating of water or another dampening fluid. An appropriate thickness of dampening fluid, corresponding to the thickness of ink, is desired so that even hydraulic pressure results upon rolling contact between the plate cylinder and the blanket cylinder.

The plate cylinder is supplied with both ink and water during printing operations. The ink is supplied through a series of ink transfer rollers and the dampening fluid, which is usually water, with or without a small quantity of additives to adjust surface tension or other characteristics, is supplied through a series of dampening rollers.

In the past, the dampening roller systems have been two basic types. One type meters the amount of water using a ducting roller which periodically contacts a pan roller which rotates in a pan of dampening fluid to carry fluid to the ducting roller. The ducting roller then moves out of contact with the pan roller and contacts one of the transfer rollers for a period of time. The speed of the pan and ducting rollers and the dwell time determines the quantity of water transferred to the plate cylinder.

Another type of dampening system is a continuous supply dampening system in which the transfer rollers continuously and simultaneously communicate with both a pan roller and a transfer roller. The quantity of dampening fluid is metered by (1) setting the pressure at a contact line or "nip" point between the pan roller and a transfer roller, or (2) an adjustable speed control motorized pan roller, using a slip nip for metering. A continuous dampening system is normally desirable for efficient high speed rotary press operation.

In a dampening system using a ducting roller, a pan roller is partially immersed into a reservoir or pan of water or dampening fluid which is maintained at a substantially constant level. The pan roller rotates in the water or dampening fluid lifting a quantity of the fluid onto the roller. A ducting roller intermittently contacts the pan roller. It rolls along the pan roller surface for a desired period of time accepting a quantity of water on the ducting roller. The ducting roller then moves out of contact with the pan roller and into contact with an intermediate roller which is chrome plated or stainless steel, so that it is hydrophilic (i.e., water receptive). The intermediate roller accepts a quantity of water from the ducting roller onto its surface. The intermediate roller is maintained in constant rolling contact with a form roller which accepts a quantity of water from the intermediate roller and applies it to the printing plate which is wrapped around and rotates with the plate cylinder. In order to maintain an even thickness of water across the entire surface of the form roller, the intermediate roller may oscillate horizontally back and forth along its axis while it is in rolling contact with the form roller. The axial oscillating or vibrating action avoids "ghosting" which might otherwise occur when the lithographic plate depletes the form roller of water in certain areas on a repeated continuous basis. The oscillation of the water receptive intermediate roller acts to smear the water onto the form roller. This continuously replenishes an even layer of water across the entire surface so that the dry areas do not appear on the printed sheet.

It has previously been thought that dissimilarity between the soft fabric covered or rubber coated form roller and the hard chrome plated or stainless steel oscillating roller was desirable. Such an arrangement allowed the two rollers to slide relative to each other while they were simultaneously in rolling contact. Further, the water receptive and grease or ink repulsive characteristic of the chrome or metal surface of the oscillating roller was considered desirable to act as a barrier against ink transfer back up through the water dampening roller system. Ink contamination in the dampening fluid or the water source was reduced. For example, subsequent printing jobs with different colored inks could sometimes be printed without purging the entire water dampening system.

In a continuous dampening system, the metering of the amount of water is not accomplished through intermittent oscillation of the ducting roller, but rather is accomplished through appropriate adjustment of pressure at a nip point between the pan roller and the adjacent transfer roller. Typically, either the pan roller or the adjacent transfer roller had flexible rubber surfaces or other flexible polymeric surfaces which permitted adjustable pressure at the rolling contact line or the nip point. Adjustment of metering pressure was accomplished between the two flexible roller surfaces. Pressure between a transfer roller and an intermediate oscillating roller or between the oscillating roller and the form roller was generally fixed or set at a minimum contact level necessary for transfer of dampening fluid. It was generally thought to be undesirable to increase this pressure as it would increase friction and/or interfere with the relative sliding or oscillating motion of the rollers.

In another system as described in U.S. Pat. No. 3,902,417 issued Sep. 2, 1975 for a wetting system for rotary offset printing presses shows the use of an oscillating transfer roller which is positively driven in synchronism with a drive from the plate cylinder. The transfer roller, although ink receptive, as with copper or a hard nylon known as RILSAN, is provided with an unyielding surface for rolling engagement with a yielding form roller which slips slightly with respect to the plate cylinder. Although the pressure between the unyielding oscillating roller and the yielding surface of the form roller is adjustable to cause a depression into the form roller or a kneading effect, it has been found that the hydraulic forces between the oscillating roller and the form roller can increase significantly as the press speed increases and that without directly increasing the adjusted pressure between the rollers, the hydraulic pressure increases sufficiently to cause bowing at the centers of the rollers which results in excessive dampening fluid in the middle of the rollers and an absence of dampening fluid at the ends of the rollers which are supported by end bearings. Adjustable pressure between the rollers has not been found to be an adequate solution. The amount of pressure required at any given speed is not easily predictable and even if pressure adjustment alone would avoid the blanking at high speeds, press operation typically requires a significant amount of speed changes from set-up, initial runs, start-up production runs and shut-down phases of operation that a press operator might find himself continuously adjusting the pressure to avoid end blanking. Some complex systems of skewing or twisting the rollers with respect to each other in order to avoid the bowing and end blanking difficulty have been used in inking roller systems but have not been found to be sufficiently simple and operational to be truly effective. Moreover, skewing or roller twisting systems have not previously been successfully implemented in dampening roller systems.

One system attempted to use an oscillating roller which was interposed in the series of transfer rollers as an intermediate oscillating roller. It was driven in rotation only by frictional rolling contact and it was driven in oscillation only with a fragile internal groove and tab mechanism. This system was fraught with deficiencies and has apparently been abandoned altogether. It appears that balancing the need for pressure for rolling contact with the need for an absence of pressure to allow the fragile oscillating mechanism to function was one factor which doomed such a system to failure.

In a dampening system described in U.S. Pat. No. 4,949,637, issued to Keller on Aug. 21, 1990, the amount of water applied was metered through the use of multiple adjustable pressure nip points. The intermediate roller had a rubber surface to permit adjusting pressure, but it did not oscillate. A separate oscillating roller was held with a light spring tension either against the form roller, against the transfer roller, or two oscillating rollers were held, one against the form roller and one against the transfer roller. The oscillating roller had a rubber surface, 95 to 100 Shore A Durometer, and was rotated through rolling contact friction, not gear driven. The oscillating mechanism was a fragile mechanism small enough to fit inside the roller itself, interposed between the roller shaft and the roller itself. This system worked and continues to work well for small size presses, less than about 22 inches wide, but adequate pressure and oscillation for larger size presses is increasingly difficult to maintain, especially with very high speed presses.

SUMMARY OF THE INVENTION

Thus, the present invention overcomes various drawbacks of the prior art by providing a dampener system for a lithographic rotary press in which a consistent thin evenly metered quantity of dampening fluid is supplied to a printing plate on the plate cylinder. The system is adaptable to high speed printing presses having wide width printing surfaces. The form roller which contacts both the plate cylinder and the oscillating roller is not gear driven. The oscillating roller is gear driven and is constructed with a unique ink receptive compressible surface, which has sufficient resiliency and compressibility to retain a quantity of ink and dampening fluid even under high speed, high pressure and uneven pressure situations. The oscillating roller is continuously supplied with a metered quantity of dampening fluid. Further, the lines of contact between the oscillating roller and the form roller and also between the oscillating roller and a transfer roller are adapted for adjustable contact pressure.

It is an additional object of the present invention to provide a fluid dampening system for a lithographic press with the oscillating roller having an ink receptive and resiliently compressible surface and in which all of the other rollers in the dampening system have ink receptive surfaces. This allows a small portion of the ink which is applied directly to the plate cylinder with an inking system to become mixed with the dampening fluid and to be carried back up through the dampening system in a consistently mixed homogenous fluid throughout so that the adjustability of the quantity of dampening fluid through pressure nip points in the dampening system is facilitated.

It is a further object of the present invention to provide a convenient, cost-effective water and ink receptive dampening retrofit kit and method for retrofitting an existing press which uses the existing gear trains, bearing mounts, and oscillating drive mechanisms of existing presses. The retrofit kit and method includes an oscillating roller which is ink receptive and smooth, yet soft and resilient and further includes the addition of adjustable nip point metering, so that a fine, even layer of dampening fluid is consistently and continuously applied to the plate cylinder of the converted lithographic printing press. In particular, the existing oscillating roller is either replaced with a roller having a smooth and resilient ink receptive cylindrical surface which is sufficiently ink receptive and sufficiently soft and resilient to operate to retain a quantity of ink even under high speed and high pressure operating conditions. Further, ducting rollers for intermittently applying dampening fluid are replaced with a continuous series of one or more transfer rollers which continuously communicate metered quantities of fluid from the pan roller onto the soft and resilient ink receptive intermediate oscillating roller. A pressure adjustment mechanism is provided for adjusting the nip point between the pan roller and the transfer rollers and also for adjusting the nip pressure between the transfer rollers and the soft and resilient ink receptive oscillating roller, as well as between the oscillating roller and the form roller.

BRIEF DESCRIPTION OF THE DRAWINGS

These and other objects and advantages of the invention will be more fully understood with reference to the following detailed description, claims and drawings, in which like numerals represent like elements and in which:

DETAILED DESCRIPTION OF THE PREFERRED EMBODIMENTS

Figure 1:
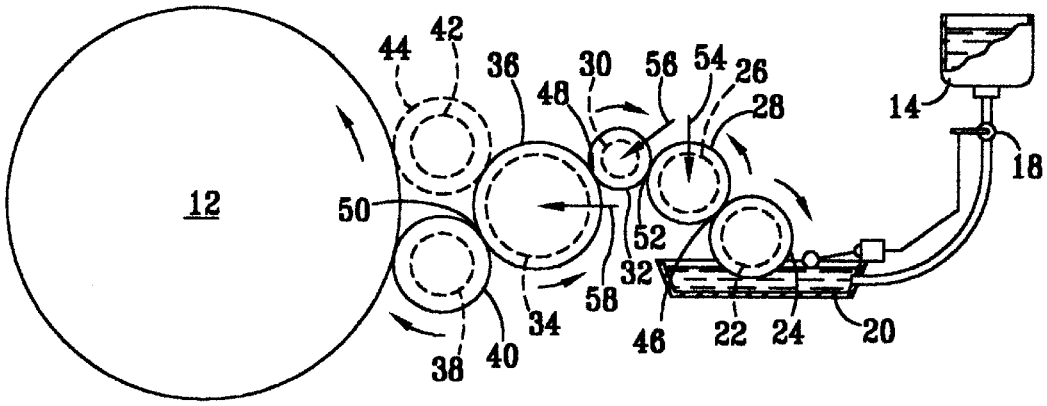
FIG. 1 is a schematic side view depicting a plate cylinder with the inventive system of dampening rollers shown in operative positions according to the present invention.

FIG. 1 shows a schematic side view of a dampening assembly view according to the present invention in position with a lithographic printing press. A fluid supply 14 fills a pan or reservoir 16 as required to maintain the dampening fluid 20 at a particular level. A fluid level maintenance system 18 may be used, which includes a level activated valve and fill tube, attached in a known fashion. The dampening fluid 20 is typically water, but may also consist of water with additives for appropriately regulating the surface tension or other characteristics of the water. Sometimes a mixture of alcohol and water might be used; however, it has been found that the alcohol/water mixture has other drawbacks and disadvantages such that its use is not normally justified.

A series of rollers transfer the dampening fluid or water to the surface of plate cylinder 12. A pan roller 22, sometimes known as a dipping roller, a fountain roller, or a water take-up roller, is partially immersed in dampening fluid 20 in pan 16. Pan roller 22 rotates through the water and a layer or quantity of water is carried upward from the pan on roller surface 24 which is preferably a smooth polymeric surface which is soft and resilient having a hardness, measured according to the Shore A Durometer scale of about 70 to 100 durometer. It has been found that nitryl rubber with a hardness of about 70 to 100 Shore A Durometer will work, according to the present invention. Nitryl rubber with Shore A hardness between about 80 and 90 durometer is preferred to give good metering and ink retention while providing durability and longevity. Such a polymeric surface is preferably both water receptive and ink receptive. A transfer roller 26 which is a primary metering transfer roller 26 also preferably has a consistently smooth polymeric roller surface 28 which rolls in contact with surface 24 of pan roller 22. Preferably, roller surface 28 is ink and water receptive and has a hardness of 25 to 40 Shore A Durometer. (Throughout this application the preferred measurements of hardness will be set forth according to the Shore A Durometer scale.) Transfer roller 26 continuously rolls against pan roller 22 receiving dampening fluid therefrom and carrying the dampening fluid through rotation for ultimate transfer to the plate cylinder 12. In the preferred embodiment depicted in FIG. 1, a reverse direction transfer roller 30 rolls against primary metering transfer roller 26, picking up dampening fluid on its roller surface 32 and carries the fluid on toward plate cylinder 12. Preferably, roller surface 32 is a polymeric surface which is water and ink receptive having a Shore A Durometer of between 25 and 40. Preferably, the hardness of the transfer roller and the reverse direction transfer rollers are adjusted towards the opposite ends of the 25 to 40 durometer range to reduce friction therebetween, particularly during press start-up when the rollers are "dry." Thus, if one transfer roller or reverse transfer roller is 40 durometer, the other is 25 durometer.

An intermediate roller 34 receives dampening fluid from the transfer rollers 26 and 30, and in particular in the embodiment shown in FIG. 1, from rolling contact with reverse direction transfer roller 30. Intermediate roller 34 moves back and forth in the axial direction, such that it is known as a vibrating or an oscillating roller 34. As will be shown more fully below, with reference to FIG. 2, intermediate oscillating roller 34 is positively driven, as from plate cylinder 12, as with a series of meshing spur gears. Also, uniquely according to the present invention, oscillating roller 34 is provided with a surface 36 which is both water receptive and ink receptive and further is sufficiently porous to retain fluid within surface pores.

Preferably, surface 36 comprises a smooth surface formed on a soft and resilient polymer material, such as soft rubber material, having a smooth cylindrical surface ground thereon. A nitryl rubber having a Shore A Durometer of about 70 to 100 and a sufficient resiliency has been found to maintain an even layer of ink and water under high speed and high pressure situations. In the arrangement depicted, surface 36 preferably has a hardness of between about 80 and 90 durometer. The resilient water and ink receptive surface 36 carries dampening fluid from the transfer rollers and provides it through rolling and sliding contact to a form roller 38. The resiliency allows the layer of water to remain on the surface between the nipping contact with other rollers, so that a lubricating layer facilitates oscillation sliding. The surface may also have a certain amount of porosity or absorbency which may facilitate ink and water receptivity, so that a continuous fluid layer is maintained on the surface 36 of the oscillating roller.

The surface of form roller 38 is also preferably ink receptive, such as a polymeric surface, which for the purposes of providing a smooth, very thin evenly metered quantity of dampening fluid to plate cylinder 12, has a hardness in the range of between 25 and 30 Shore A Durometer. A second form roller 42, shown in phantom lines, having a second form roller surface 44, and which is preferably a polymeric material having a hardness in the range of 25 to 30 Shore A Durometer, may also be used, but is not required for proper operation of the dampening fluid system according to the present invention.

Unlike intermittent or ducting dampening systems which the present invention is adapted to replace, metering of the dampening fluid is accomplished through nip points where the transfer rollers contact one another to form a line or "stripe" of contact. The primary metering for the present invention is accomplished at primary metering nip point 46. Water carried upward on roller 22 is squeezed or "squeegeed" off of pan roller 22 with adjustable nip pressure device 54 for selectively applying desired rolling contact forces at nip point 46 along a line which extends across the entire face of roller 22. Only a small quantity of water successfully spreads over the contacting surfaces 24 and 28 by hydraulic pressure action. The remainder forms a small wave which drips or sprays back into pan 16. A portion of the quantity of dampening fluid which moves past nip point 46 is carried on surface 24 and another quantity is carried on surface 28. A portion of this is transferred at contact point 52 onto reverse transfer roller 30. As the direction of rotation places contact point 52 above the rollers, any small wave of water formed at contact point 52 continues to be trapped by rotation and the force of gravity at the "V" between surfaces 28 and 32. Thus, nip point 52 does not normally function as an efficiently effective metering nip point. Again, a portion of the fluid moving through point 52 is carried on surface 28 back to metering nip point 46 while another portion is carried on surface 32 to nip point 48 where surface 32 contacts surface 36, of oscillating roller 34, with a metering pressure device 56 for selectively applying desired rolling contact forces between transfer roller 30 and oscillating roller 34.

In previous systems where the surface of the oscillating roller was chrome plated or stainless steel or another metallic surface which was hydrophilic and was not ink receptive, contact between the transfer rollers and the oscillating rollers did not form an effective nip point for metering the fluid. The goal was to merely provide transfer of fluid from the transfer rollers "downstream" to the oscillating roller and onto the form roller and plate cylinder, without having any significant quantity of ink transferred in the opposite direction from the plate cylinder to the form roller to the oscillating roller and back "upstream" through the transfer rollers into the dampening system. For this reason, the surface of most prior oscillating rollers was designed to repel the ink. Nevertheless, ink was transferred from the form roller, but it resulted in a non-homogenous mixture of ink and water carried on the exterior of the oscillating roller. Any attempt to meter through nipping pressure with this non-homogenous fluid would likely face erratic if not totally unsuccessful results.

Further, both for hydrophilic surfaces, such as smooth metallic chrome or stainless steel surfaces, and also for hydrophobic materials, such as copper or hard nylon, a goal was to minimize sliding friction. The surfaces were very hard, and the contact force normal to the cylinder (ie., the nip pressure) was minimized for purposes of minimizing sliding friction during oscillation of the roller in an axial direction. High speed and high pressure operation caused the center of these hard surface rollers to bow outward due to the high hydraulic pressure developed. The ends of the rollers, directly adjacent the support bearings would run dry. Either the pressure 56 had to be continuously adjusted according to the speed, which was difficult, inaccurate and time-consuming, or the rollers had to be skewed or skewed and twisted by placing them under extreme loading forces which required heavy structure and was complicated and inaccurate. Starting and stopping a run on an offset printing press requires going through a variety of speeds. Also, setup requires slower speeds to avoid ruining a large number of prints. Yet, production runs require high speed operation. Pressure adjustment is simply not an adequate solution.

Uniquely according to the present invention, using a resiliently compressible ink receptive surface 36 facilitates formation of a homogenous mixture of the ink and dampening fluid which is carried on surface 36 of oscillating roller 34. Also, under conditions of high contact pressure and during high speed operation, the compressibility allows a quantity of fluid to remain along the entire length of the roller so that total depletion of the fluid at the ends is avoided, even under conditions of high rolling contact pressure and high speed operation. The retained fluid on the surface of the oscillating roller provides a continuous fluid layer. As a result of this homogeneity and continuous fluid layer, an effective nipping point 48 can be achieved at the rolling contact line between the oscillating roller and the transfer rollers. It has been found, contrary to traditional wisdom, that it is desirable to allow the mixture of water and ink to move in the reverse direction upstream through the series of dampening fluid transfer rollers. It appears in practice that the water rides on the ink, so that effective, uniform, and consistent transfer of water from the reservoir 16 onto plate cylinder 12 is facilitated by allowing an equilibrium condition of an ink and water mixture to be formed entirely throughout the dampening system. During operation of the press for a short period of time, the movement of ink in a reverse direction is facilitated by ink receptive rollers at each position, all the way up the dampening system series of rollers. Transfer roller 30 is positioned in interference contact with oscillating roller 34 so that a line of compression is achieved. This effectively acts upon the homogeneous mixture to achieve a secondary metering of the ink and water film at nip point 48. Particularly where the surface 36 of oscillating roller 34 is a compressible resilient polymeric material, a line of compression is formed at each of the surfaces 32 and 36. Preferably, surface 36 is maintained at a sufficiently different hardness from hardness of surface 32, so that sliding contact is facilitated particularly during dry start up operating. As the form roller 38 has been found to function well with a relatively soft surface 40 for rolling against plate cylinder 12, it is preferable to have a relatively harder yet compressible surface 36 at nip point 50. Thus, the surfaces 32 and 40 on transfer roller 30 and form roller 38, respectively, are made of a softer material than the surface 36 of oscillating roller 34 so that there will be reduced friction during axial oscillation at both nip points 48 and 50. These nip points are of course actually nip lines extending entirely along the rollers in the axial direction.

It is also theorized that, because of the "greasy" nature of ink and also because of the ability of ink to carry water in a type of coalescence or encapsulation, the ink and water mixture acts as a very effective lubricant at nip points 48 and 50 to allow non-binding oscillation. The unique surface compressibility of the oscillating roller 34 advantageously retains a quantity of dampening fluid and ink mixture during operation. Thus, where oscillating roller 34 is both gear driven in rotation and also externally driven with a strong, durable external eccentrically operated mechanism, a press dampening system with a uniquely resiliently compressible ink receptive oscillating roller has been found to have substantially improved performance characteristics.

It is noted that where the dampening fluid can be applied in a consistently evenly distributed layer, the thickness of the water layer is very, very thin and has been characterized during desired operating conditions as more of a mist or a fog of dampening fluid rather than a layer of dampening fluid. In normal atmospheric conditions, if the press is stopped suddenly, the entire quantity of dampening fluid on the plate cylinder may evaporate in seconds, leaving the plate cylinder (in non-inked areas) dry to the touch.

Further, as the nip point 50 between the oscillating roller and the form roller has substantially all the same characteristics as nip point 48, adjustable pressure device 58 for selectively applying desired rolling contact forces between oscillating roller 36 and form roller 38, and sliding oscillation contact can be advantageously adjusted so that the layer of dampening fluid and ink mixture resulting on form roller 38 is squeezed and smeared into a very thin, even and consistent layer. The application of additional pressure 58 at nip point 50, and the fact that the layer of ink and dampening fluid on receptive oscillating roller 34 is a substantially homogenous mixture, results in a smooth squeezing action without erratic "bubbles" or "globs" of ink or water which might otherwise result in a non-homogenous mixture on an oscillating cylinder which is not ink receptive and not compressible.

Figure 2:
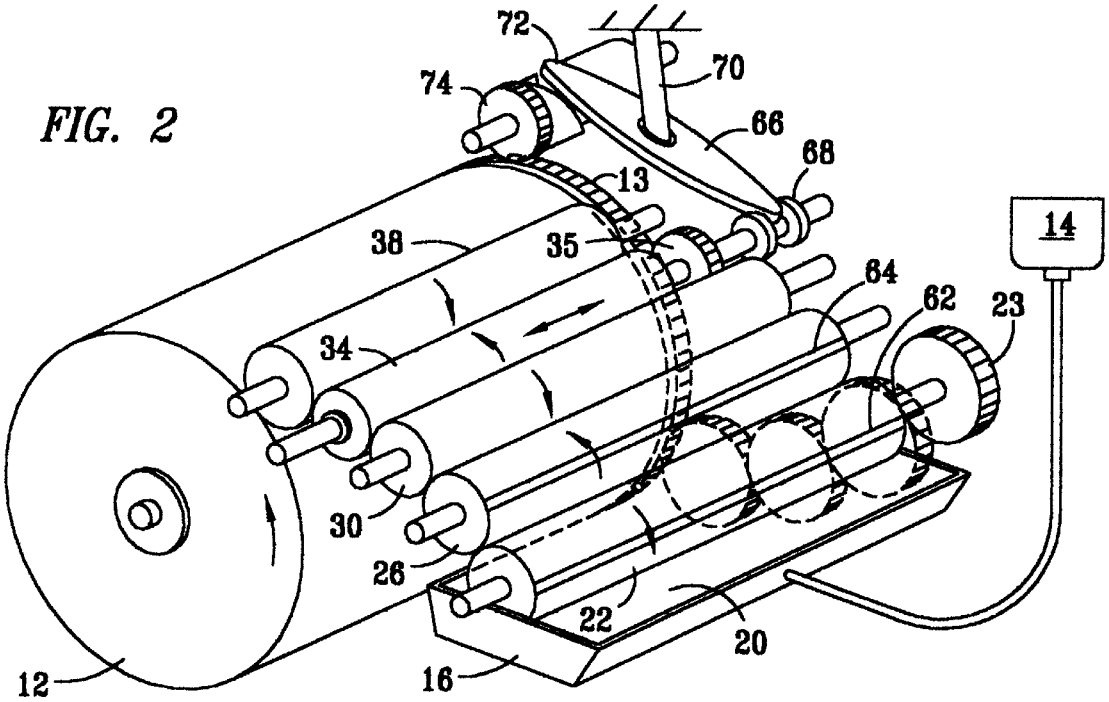
FIG. 2 is a partial perspective view of a dampening system according to the present invention showing a series of dampening rollers.

FIG. 2 schematically depicts in a perspective view a plate cylinder with the gear driven dampening system according to the present invention. Gear 35 is driven from a series of gears so that the surface speed of the oscillating roller 34 is the same as the surface speed of form roller 38, which matches the surface speed of the plate cylinder. The pan roller 22 is preferably driven with a gear 23 which meshes with a series of gears from plate cylinder gear 13 to allow pan roller to be driven to match the surface speed of the plate cylinder. Thus, the rotation of each of the rollers in the series is at a preferred 1:1 surface speed ratio. This ratio is believed desirable for purposes of maintaining effective hydraulic nip points between the rollers. However, consistently proportional speed differences between the rollers so that a controlled proportional slippage occurs at each nip point might also be useful without departing from the invention. When such potential slippage is called for, the continuous maintenance of a "lubricating" film of dampening fluid and ink mixture as facilitated with resiliently compressible ink receptive rollers further facilitates non binding rotational slippage. Positive driving of the oscillating roller as compared to being frictionally driven by surface contact between the form roller and the oscillating roller allows the system to start up and establish equilibrium without binding or breakage even for large press widths in excess of 22 inches.

In FIG. 2, compressed lines or stripes 62 and 64 shown on the pan roller and transfer roller, respectively, are indicative of the pressure at nip point 46. Stripes are measured with the press stopped by holding the rollers in contact at a given rotary position for a short period of time and then quickly rotating the rollers a short distance to a new location. The area which indicates a substantial absence of ink or fluid due to the compression of the flexible surfaces of the respective rollers causes a stripe, the width of which depends upon the pressure between the rollers. The stripe should be adjusted so that it is an even width entirely along the length of the roller and further, the width of the stripe is set so that desired metering is accomplished. Typically, stripes measuring about 5/32nds of an inch at each of the nip points for a 22 inch rotary press will provide a fine consistent film of dampening fluid on the plate cylinder. At the nip between the metering and pan roller, more dampening fluid can be provided by having a narrower width stripe and less fluid can be provided by increasing the width of the stripe. The experience of the press operator will facilitate determining the width of the stripe for a particular press or for a particular lithographic printing job being performed on the press.

Also shown schematically in FIG. 2 is an oscillating arm 66 which is engaged in a channel 68 which drives the oscillating roller axially back and forth. Oscillating arm 66 pivots about a fixed pivot point 70 through the operation of follower end 72 which follows an oscillating eccentrically operated mechanism 74 which may be a cam, a crank, or other device which is directly driven through rotation of the press to produce an oscillating motion. This direct drive oscillating system is sufficient in the embodiment disclosed to move the oscillating roller 34 in an axial direction even at a substantially dry start-up condition and maintains a constant oscillating or vibrating action during operation. Once equilibrium is reached, the lubricating nature of the ink receptive surface with an ink and water mixture thereon, allows the eccentrically operated mechanism 74 to function without adverse wear or power loss.

Figure 3:
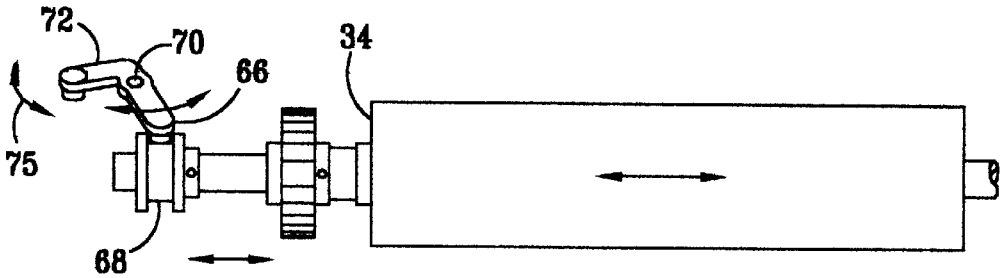
FIG. 3 is a side view of a gear driven and external eccentrically operated intermediate oscillating roller which is both gear driven from the plate cylinder and positively oscillated with a press driven eccentrically operated arm.

FIG. 3 is a front view of an oscillating roller 34 according to the present invention, in which the operation of an oscillating eccentrically operated mechanism 74 is schematically depicted as arrow 75 exterior to the oscillating roller 34. Sufficient size and strength allows adequate force to be applied for oscillating roller 34 even at dry or start-up conditions.

Figure 4:
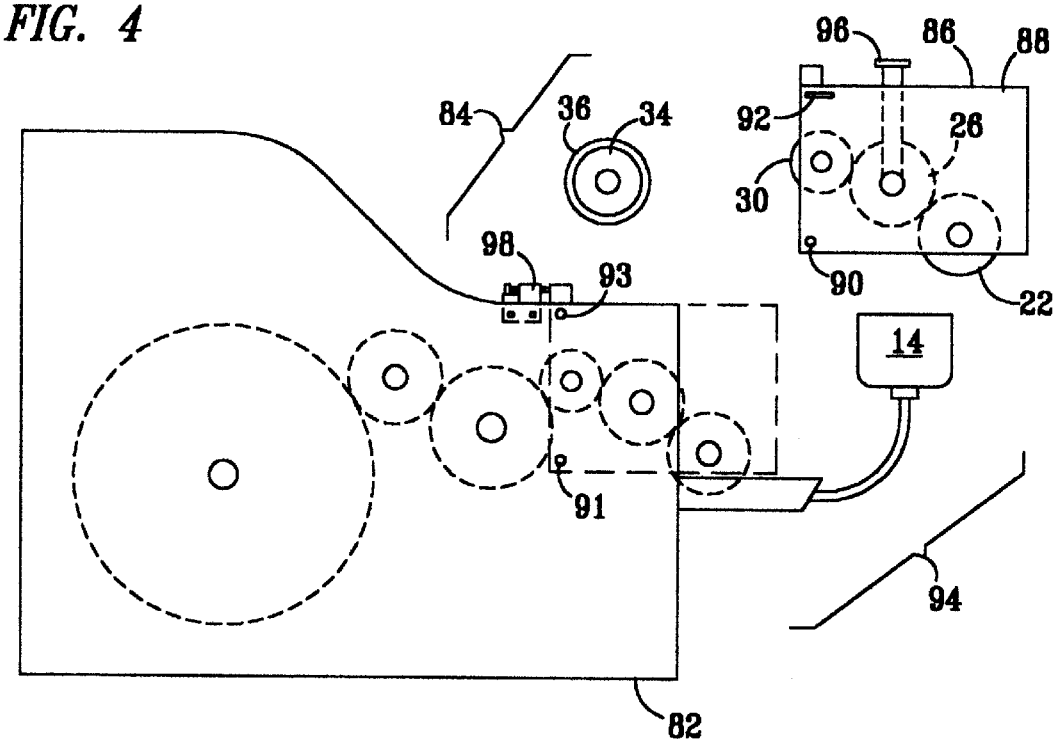
FIG. 4 is a schematic depiction of an assembly view depicting replacement of the existing intermediate oscillating roller with a roller according to the present invention and replacement of existing dampening system transfer rollers and pan roller with an assembly corresponding to the present invention.

FIG. 4 schematically depicts a side assembly view of an existing lithographic press 82 showing a kit and method for conversion of its ink dampening system to a continuous dampening system with an ink receptive oscillating roller which is resiliently compressible, according to the present invention. The existing transfer rollers and the intermediate chrome plated or metallic oscillating roller are removed. The driving mechanism for the form roller 38 and the oscillating roller are retained. The existing oscillating roller is replaced in an assembly step 84 with an oscillating roller 34 preferably having a resiliently compressible ink receptive surface 36, and more preferably having a degree of porosity to facilitate liquid retention. Either the same or a substantially duplicate drive gear 35 and external oscillation mechanism (not shown in FIG. 4) is reused. A pan roller and transfer roller assembly 86 can be bolted or otherwise rigidly attached to the press 82 in an appropriate position. Preferably, assembly 86 has the pan roller 22 and first and second transfer rollers 26 and 30 appropriately positioned and mounted within a frame 88. The frame 88 is connected to the press with connection means 90, 91, 92 and 93 (such as holes 90 and 92 and bolts 91 and 93), during another assembling step 94. A desired nip pressure between transfer roller 26 and pan roller 22 is provided by adjustable positioning means 96 so that a metering stripe can be achieved which is of a desired width corresponding to the pressure. Once the location of roller 26 is adjusted, it can be locked down in the desired position for operation. The nip pressure between roller 30 and oscillating roller 34 may, for example, be achieved with position adjustment means 98 which is secured between press 82 and dampener assembly frame 88. Adjustment means 98 may, for example, include a progressively tightenable mechanism which is held in a particular position as with a spring loaded device which "clicks" into incrementally tighter positions. Press men often refer to pressure for a given dampening mechanism by the total number of "clicks" from the first roller to roller contact position or the "O" click position. One click would be relatively light pressure and 10 clicks would be a relatively high pressure.

Figure 5:
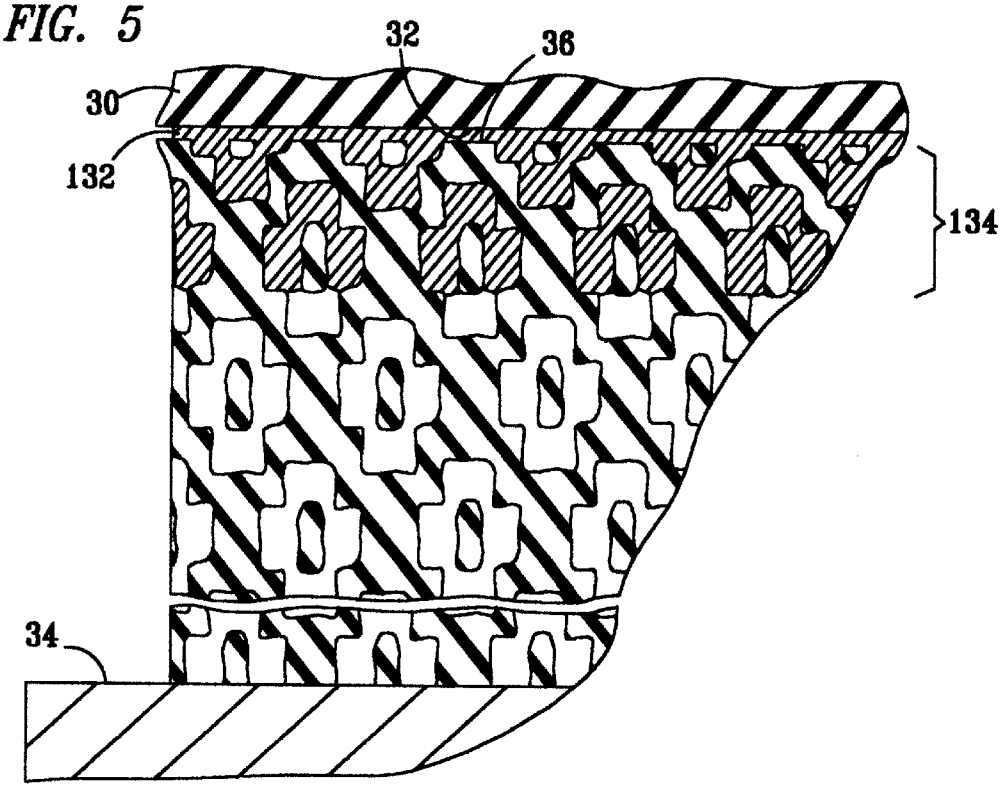
FIG. 5 is a schematic depiction of an enlarged slice of material perpendicular to a roller surface showing the compressibility of an ink receptive oscillating roller which is soft and resilient.

FIG. 5 is a schematic depiction of an enlarged radial segment sliced perpendicular through a surface 36 of a resiliently compressible ink receptive roller, according to one preferred embodiment of the present invention, in which a mixture of ink and dampening fluid 132 is retained to a depth 134 and on the surface 36, even under high pressure contact with the form roller. A molded nitryl rubber, in addition to resilient compressibility, may also have minute pores which can facilitate the ink receptivity and retention of a layer of dampening fluid under high speed and high contact pressure conditions.

Figure 6:
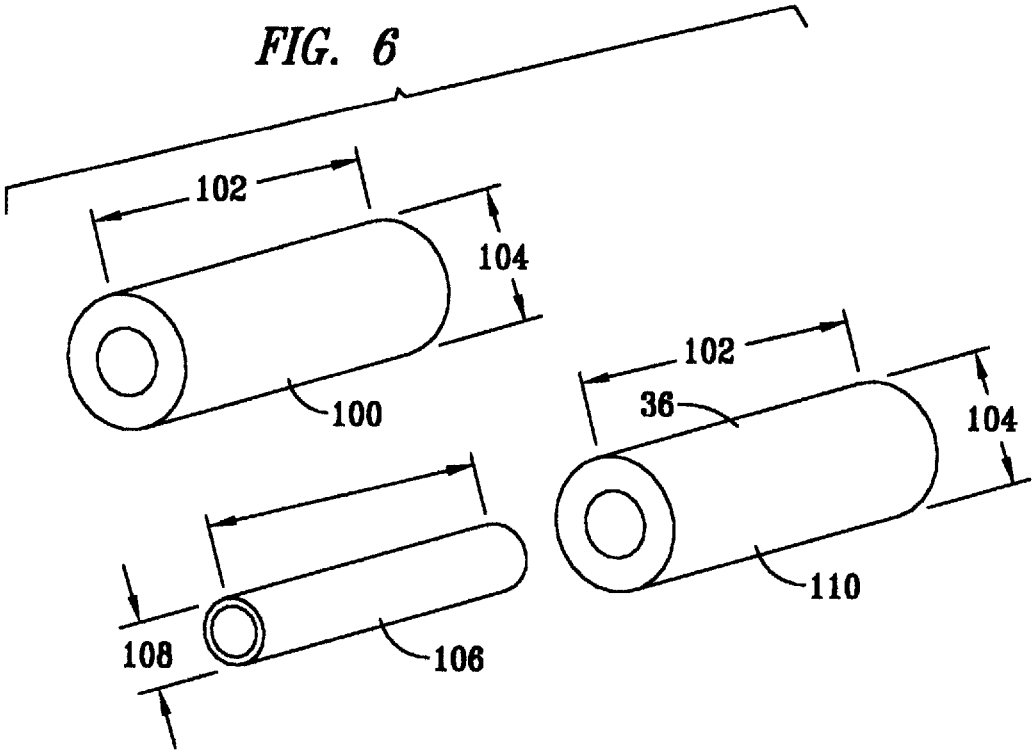
FIG. 6 is a schematic depiction of a step in an alternative construction of an ink receptive oscillating roller according to the present invention.
Figure 7:
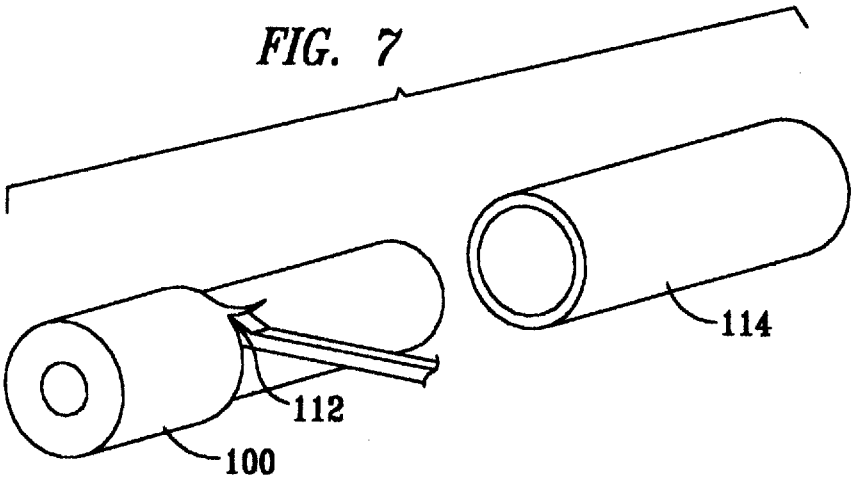
FIG. 7 is a schematic depiction of another step in the alternative construction of an ink receptive oscillating roller according to the present invention.

FIGS. 6 and 7 depict alternative constructions methods for making the surface 36 of oscillating roller 34 ink receptive, either for purposes of building a press with the desired dampening system or for purposes of converting existing oscillating rollers. FIG. 6 schematically depicts an existing oscillating roller 100 having a length measurement 102 and a diameter 104. The central hub 106 of new ink receptive oscillating roller 34 will have a corresponding length dimension but will have an exterior diameter 108 substantially smaller than the final surface diameter 104 of the existing roller. A polymeric sleeve 110 corresponding to the exterior surface 36 is pressed or otherwise formed securely over the central or interior hub 106 and has a length and width which is the same as the roller that it replaces.

In FIG. 7, a machining process and assembly is schematically depicted in which an existing roller 100 has its surface diameter made smaller as at machining operation 112. A polymeric sleeve 114 is press fit or otherwise formed securely on the machined roller 100 to form a new oscillating roller 34.

The ink receptive roller from either of FIGS. 5, 6 or 7 is then installed or reinstalled in the press as indicated in FIG. 4. The press is otherwise converted with appropriate continuous feed dampening transfer rollers according to the present invention.

Thus, what has been disclosed is a dampening system and a dampening system retrofit kit and method by which a lithographic press is provided with an entirely ink receptive dampening system having a gear driven ink receptive oscillating roller. Thus, a consistent smooth thin layer of metered dampening fluid can be continuously applied to a lithographic press. Further, the conversion or retrofitting of an existing press is simple and cost-effective as the oscillating mechanism of the existing press, the bearings, gears and oscillating drive mechanisms are essentially reused without substantial redesign, except for the inventive features of the oscillating roller and transfer rollers or equivalent modifications as described herein.

While the invention has been described in connection with preferred embodiments, it is not intended to limit the scope of the invention to the particular form or forms set forth, but on the contrary, it is intended to cover such alternatives, modifications, and equivalents as may be included within the spirit and scope of the invention as defined by the appended claims.

What is claimed is:

1. An apparatus for continuously providing dampening fluid to a lithographic printing press comprising:

(a) a printing press having a rotatable plate cylinder and a gear mechanism driven by rotation of said plate cylinder;

(b) a dampening fluid reservoir operatively connected to said printing press, for supplying said dampening fluid to be provided to said rotatable plate cylinder;

(c) a pan roller rotatably mounted, operatively connected to said printing press and disposed adjacent to said dampening fluid reservoir, for receiving said dampening fluid therefrom;

(d) at least one transfer roller, operatively connected to said printing press, tangentially contacting and parallel to said pan roller;

(e) an oscillating roller having a resiliently compressible ink receptive surface, said oscillating roller operatively connected to said printing press, tangentially contacting and parallel to said transfer roller, said oscillating roller being gear driven and coupled to said rotatable plate cylinder through said gear mechanism for rotating said oscillating roller at a surface speed proportional to a surface speed of said rotatable plate cylinder; and (f) a form roller rotatably mounted, operatively connected to said printing press, tangentially contacting and in a parallel relation to both said plate cylinder and said ink receptive oscillating roller for carrying an even metered layer of dampening fluid from said oscillating roller to said plate cylinder.

2. An apparatus, as in claim 1, wherein said ink receptive oscillating roller further comprises a polymeric surface having a hardness measuring between about 70 to 100 Shore A Durometer.

3. An apparatus, as in claim 1, wherein said ink receptive oscillating roller comprises a polymeric surface having a hardness measuring between about 80 and 90 Shore A Durometer.

4. An apparatus, as in claim 1, wherein each of said pan roller and transfer roller and form roller have ink receptive polymeric surfaces.

5. An apparatus, as in claim 1, wherein said at least one transfer roller contacts said pan roller and said apparatus further comprises a reverse direction roller contacting said at least one transfer roller and said oscillating roller.

6. An apparatus, as in claim 1, wherein said pan roller further comprises a gear drive, operatively connected to said printing press for rotating said pan roller at a surface speed proportional to a surface speed of said rotatable plate cylinder.

7. An apparatus, as in claim 1, wherein said resiliently compressible ink receptive surface of said oscillating roller has a characteristic of absorption of a mixture of ink and dampening fluid.

8. An apparatus, as in claim 1, wherein said resiliently compressible ink receptive surface of said gear driven oscillating roller comprises pores into which dampening fluid is penetrable.

9. An improved gear driven continuous fluid dampening system of the type having a plurality of tangentially contacting and parallel cylindrical rotatable rollers structurally held in relationship to each other and having a dampening fluid pan, said plurality of rotatable rollers comprising:

(a) a pan roller positioned for receiving dampening fluid from said dampening fluid pan with an ink receptive polymeric surface having a hardness of about 80 to 100 Shore A Durometer;

(b) a transfer roller positioned for receiving dampening fluid from said pan roller with an ink receptive polymeric surface having a hardness of about 25 to 40 Shore A Durometer;

(c) a reverse direction roller for receiving dampening fluid from said transfer roller with an ink receptive polymeric surface having a hardness of about 25 to 40 Shore A Durometer and which is different from the hardness of the transfer roller;

(d) an oscillating roller positioned for receiving dampening fluid from said reverse direction roller, and said dampening system further comprising;

(e) an ink receptive and compressible surface on said oscillating roller having a hardness of about 80 to 100 Shore A Durometer;

(f) a gear train driving said oscillating roller for rotation thereof at speeds directly proportional to rotation of a plate cylinder of a lithographic printing press;

(g) means for selectively applying desired rolling contact forces both between said oscillating roller and said reverse direction roller and between said oscillating roller and said form roller; and (h) a form roller with an ink receptive polymeric surface having a hardness of about 25 to 30 Shore A Durometer for receiving dampening fluid from said oscillating roller and for providing said dampening fluid to a rotating plate cylinder of a lithographic printing press.

10. An improved fluid dampening system, as in claim 9, wherein said ink receptive and compressible surface of said oscillating roller further comprises a smooth resiliently compressible polymeric material.

11. An improved fluid dampening system, as in claim 10, wherein said smooth resiliently compressible polymeric material comprises rubber.

12. An apparatus for continuously providing dampening fluid to a rotating plate cylinder of a lithographic printing press, of the type having a gear mechanism for driving an existing oscillating roller having a gear attached thereto and a form roller in contact with said existing oscillating roller and said rotating plate cylinder, as part of an existing dampening system for said lithographic printing press, said apparatus comprising:

(a) a frame, having means for connection to said printing press;

(b) a dampening fluid reservoir having means for connection to said lithographic printing press;

(c) a pan roller, rotatably mounted in said frame and disposed adjacent to said dampening fluid reservoir for receiving dampening fluid therefrom;

(d) a transfer roller means, rotatably mounted in said frame, so that it tangentially contacts, and is parallel to, said pan roller for receiving dampening fluid therefrom;

(e) an ink receptive replacement oscillating roller attachable to said lithographic printing press, contacting and parallel to said transfer roller means, said replacement oscillating roller having a gear attached thereto, which gear is sized and shaped for coupling to said rotating plate cylinder through said gear mechanism so that said replacement oscillating roller is rotated at a surface speed which matches a surface speed of said rotating plate cylinder, and having a resiliently compressible surface for tangentially contacting both said transfer roller means and said form roller so that an even, metered layer of dampening fluid is provided from said oscillating roller to said form roller, and in turn, to said plate cylinder.

13. An apparatus, as in claim 12, wherein said resiliently compressible surface of said replacement ink receptive oscillating roller further comprises an absorbent polymeric surface, having a hardness measuring between about 80 to 100 Shore A Durometer.

14. An apparatus, as in claim 13, wherein said absorbent polymeric surface has absorption characteristics for absorbing a mixture of ink and dampening fluid.

15. An apparatus, as in claim 12, wherein said replacement ink receptive oscillating roller has pores sufficient in number and sufficient in size so that dampening fluid penetrates thereinto.

16. A continuous dampening system kit for retrofitting an existing lithographic printing press having gears to drive an oscillating roller, said retrofitting kit comprising:

(a) a replacement oscillating roller engagable with said gears, and with an ink receptive resiliently compressible cylindrical surface; and (b) a replacement pan-roller, transfer roller, and reverse direction roller set including means for adjusting contact pressure between said pan roller and said transfer roller of said set and between said reverse direction roller of said set and said oscillating roller.

17. A method of retrofitting an existing lithographic printing press, having a gear mechanism for driving an existing metallic or chrome plated oscillating roller with a dampening system which continuously provides dampening fluid with improved metering capabilities, comprising the steps of:

(a) replacing said existing metallic or chrome plated gear driven oscillating roller with an ink receptive gear driven oscillating roller having a resiliently compressible surface; and (b) replacing existing pan and transfer rollers with a pan and transfer roller set including means for adjusting contact pressure between a pan roller and a transfer roller of said replaced set and between a reverse direction roller of said replacement set and said ink receptive gear driven oscillating roller.

* * * * *